US006007583A

United States Patent [19]

Nestler

[11] Patent Number: 6,007,583

[45] Date of Patent: Dec. 28, 1999

[54] USE OF AMINONITRILE N-OXIDES AS BLEACH ACTIVATORS

[75] Inventor: Bernd Nestler, Frankfurt, Germany

[73] Assignee: Clariant GmbH, Frankfurt, Germany

[21] Appl. No.: 09/174,841

[22] Filed: Oct. 19, 1998

[30] Foreign Application Priority Data

Oct. 20, 1997 [DE] Germany ..... 197 46 290

[51] Int. Cl.[6] ..... D06L 3/02; C11D 7/18; C11D 7/32; C11D 7/54

[52] U.S. Cl. ..... 8/111; 510/303; 510/311; 510/314; 510/372; 510/376; 510/378; 510/503; 252/186.38; 252/186.41; 558/299; 558/303; 558/317; 558/332

[58] Field of Search ..... 510/303, 311, 510/314, 372, 376, 378, 503; 8/111; 252/186.38, 186.41; 558/299, 303, 317, 332

[56] References Cited

U.S. PATENT DOCUMENTS

| | | | |
|---|---|---|---|
| 3,961,884 | 6/1976 | Hertel et al. | 8/532 |
| 4,883,917 | 11/1989 | Smith et al. | 564/292 |
| 5,236,616 | 8/1993 | Oakes et al. | 510/376 |
| 5,478,356 | 12/1995 | Kaaret | 510/226 |
| 5,591,378 | 1/1997 | Deline et al. | 252/186.38 |

FOREIGN PATENT DOCUMENTS

| | | |
|---|---|---|
| 0303520 | 2/1989 | European Pat. Off. . |
| 0790244 | 8/1997 | European Pat. Off. . |
| 802035 | 9/1958 | United Kingdom . |
| WO 96/06912 | 3/1996 | WIPO . |
| WO 96/40661 | 12/1996 | WIPO . |
| WO 97/42295 | 11/1997 | WIPO . |

OTHER PUBLICATIONS

European Search Report.
Derwent Patent Family Report and/or Abstract.

*Primary Examiner*—Yogendra Gupta
*Assistant Examiner*—Gregory R. Delcotto
*Attorney, Agent, or Firm*—Miles B. Dearth

[57] ABSTRACT

Use of compounds of the formula (1)

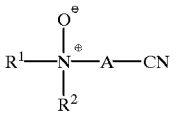

where the radicals $R^1$, $R^2$ and A are as defined in the description, as bleach activators in bleaching detergents and cleaners.

13 Claims, No Drawings

USE OF AMINONITRILE N-OXIDES AS BLEACH ACTIVATORS

BACKGROUND OF THE INVENTION

It is known that the bleaching power of peroxidic bleaches such as perborates, percarbonates, persilicates and perphosphates can be improved such that the bleaching effect starts at lower temperatures, for example at or below 60° C., by adding the precursors of bleaching peroxy acids, which are often referred to as bleach activators.

Many substances are known as bleach activators from the prior art. These are usually reactive organic compounds having an O-acyl or N-acyl group, which in alkaline solution, together with a source of hydrogen peroxide, form the corresponding peroxy acids.

Representative examples of bleach activators are N,N,N',N'-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglycoluril (TAGU), tetraacetylcyanic acid (TACA), di-N-acetyldimethylglyoxine (ADMG) and 1-phenyl-3-acetylhydantoin (PAH). Reference may be made, for example, to GB-A-836 988, GB-A-907 356, EP-A-0 098 129 and EP-A-0 120 591.

Over time, nitrilic bleach activators have gained in importance since they have proven to be extraordinarily bleaching-active. On perhydrolysis, these compounds probably form a peroxyimidic acid, which is the bleaching agent.

Such nitrilic bleach activators and their use as bleach activators in bleaches are described, for example, in EP 303 520, GB 802 035, U.S. Pat. No. 4,883,917, U.S. Pat. No. 5,478,356, U.S. Pat. No. 5,591,378, WO 9 606 912 and WO 9 640 661.

SUMMARY OF THE INVENTION

Surprisingly, it has now been found that aminonitrile N-oxides and salts derived therefrom have a better bleaching effect than bleach activators according to the prior art.

The invention thus provides for the use of aminonitrile N-oxides of the formula (1) or salts thereof, (1)

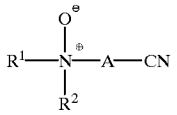

in which $R^1$ and $R^2$ independently of one another are substituted or unsubstituted $C_1$–$C_{15}$-alkyl, cycloalkyl or aryl radicals which may be substituted by fluorine, chlorine, bromine, $C_1$–$C_5$-alkoxy, $C_1$–$C_5$-alkoxycarbonyl, amino, ammonium, carboxyl, cyano or cyanamino, or together with the nitrogen atom to which they are bonded form a ring having from 4 to 6 carbon atoms which may be substituted by $C_1$–$C_5$-alkyl, $C_1$–$C_5$-alkoxy, $C_1$–$C_5$-alkanoyl, phenyl, amino, ammonium, cyano, cyanamino, chlorine or bromine, which ring can contain, in addition to the nitrogen atom and instead of —$CH_2$— groups, one or two oxygen atoms or a group

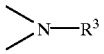

in which $R^3$ is hydrogen, $C_1$–$C_7$-alkyl or cycloalkyl, phenyl or $C_7$–$C_9$-alkylaryl, and A is a $C_1$–$C_5$-alkylene, a $C_5$–$C_{10}$-cycloalkylene or an arylene radical, as bleach activators. The terms "aryl" and "arylene" in the above formula are preferably "phenyl" and "phenylene" respectively.

The aminonitrile N-oxides to be used according to the invention also include their salts, for example those salts obtained, for example, by reacting the corresponding aminonitrile N-oxide with acids such as, in particular, HCl, HBr, HF, $H_2SO_4$, $H_3PO_4$ and other acidic phosphates, pyro-, meta- and polyphosphoric acid, $HBF_4$, $HPF_6$, $H_2CO_3$, $HNO_3$—, citric acid, formic acid, $R^4SO_4H$, $R^4SO_3H$, $R^4COOH$, where $R^4$ is a substituted or unsubstituted $C_1$–$C_{21}$-alkyl or aryl radical.

DESCRIPTION OF THE PREFERRED EMBODIMENT

Preference is given to aminonitrile N-oxides or salts thereof of the formula 1 in which $R^1$ and $R^2$ are $C_1$–$C_4$-alkyl, in particular methyl, and A is phenylene. The aminonitrile N-oxides and the salts derived therefrom are readily accessible by reacting aminonitriles with oxidizing agents; such reactions are described, for example, in J. Backes "Amine", Methoden der Organischen Chemie (Houben-Weyl), D. Klamann (Ed.) Vol. E 16d (1992), p. 1235–1329 and the literature cited therein.

The invention also provides for the use of these bleach activators in bleaching detergents and cleaners and in paper and textile bleaching. In addition to a peroxide compound and the bleach activator, the detergents and cleaners usually also comprise surface-active compounds and other known ingredients.

Suitable peroxidic bleaches are alkali metal peroxides, organic peroxides such as urea peroxide, and inorganic persalts, such as the alkali metal perborates, percarbonates, perphosphates, persilicates and persulfates. Mixtures of two or more of these compounds are also suitable. Particular preference is given to sodium perborate tetrahydrate and especially sodium perborate monohydrate. Sodium perborate monohydrate is preferred because of its good storage stability and its good solubility in water. Sodium percarbonate may be preferred on environmental grounds. Alkyl hydroperoxides are another suitable group of peroxide compounds. Examples of these substances are cumene hydroperoxide and tert-butyl hydroperoxide.

The proportion by weight of the nitrilic bleach activator according to the invention in detergents and cleaners can be from about 0.05 to 20%, preferably from 0.5 to 10%, in particular from 1 to 7.5%, together with a peroxide compound. The proportion by weight of these peroxide compounds is usually from 1 to 60%, preferably from 4 to 30%, in particular from 10 to 25%.

The detergents and cleaners may also comprise, in addition to the bleach activators according to the invention, other suitable bleach activators, for example TAED, tetraacetylglycoluril, glucose pentaacetate, sodium nonanoyloxybenzenesulfonate, benzoylcaprolactam or nitrilic activators. These additional bleach activators can be present in an amount of from 1 to 10% by weight.

The surface-active substance can be derived from natural products, such as soap, or is a synthetic compound from the group consisting of anionic, nonionic, amphoteric, zwitterionic or cationic surface-active substances or mixtures thereof. Many suitable substances are available commercially and are described in the literature, for example in "Surface active agents and detergents", Vol. 1 and 2, by Schwartz, Perry and Berch. The total amount of the surface-active compounds can be up to 50% by weight, preferably from 1% by weight to 40% by weight, in particular from 4% by weight to 25% by weight.

Synthetic anionic surface-active substances are, usually, water-soluble alkali metal salts of organic sulfates and sulfonates having $C_8$–$C_{22}$-alkyl radicals, the term "alkyl" including the alkyl substituents of higher aryl radicals.

Examples of suitable anionic detergents are sodium and ammonium alkylsulfates, especially the sulfates obtained by sulfating higher ($C_8$ to $C_{18}$) alcohols; sodium and ammonium alkylbenzenesulfonates having a $C_9$–$C_{20}$-alkyl radical, especially linear secondary sodium alkylbenzenesulfonates having a $C_{10}$–$C_{15}$-alkyl radical; sodium alkyl glycerol ether sulfates, especially the esters of the higher alcohols derived from tallow oil and coconut oil; the sodium sulfates and sodium sulfonates of coconut fatty acid monoglycerides; sodium and ammonium salts of the sulfuric esters of higher ($C_9$ to $C_{18}$) alkoxylated fatty alcohols, especially those alkoxylated with ethylene oxide; the reaction products of the esterification of fatty acids with isethionic acid and subsequent neutralization with sodium hydroxide; sodium and ammonium salts of the fatty acid amides of methyltaurine; alkanemonosulfonates such as those from the reaction of α-olefins ($C_8$–$C_{20}$) with sodium bisulfite and those from the reaction of paraffins with $SO_2$ and $Cl_2$ with subsequent basic hydrolysis to give a mixture of different sulfonates; sodium and ammonium dialkylsulfosuccinates having $C_7$–$C_{12}$-alkyl radicals; and olefinsulfonates formed in the reaction of olefins, especially $C_{10}$–$C_{20}$-α-olefins, with $SO_3$ and subsequent hydrolysis of the reaction products. The preferred anionic detergents are sodium alkylbenzenesulfonates having $C_{15}$–$C_{18}$-alkyl radicals, and sodium alkyl ether sulfates having $C_{16}$–$C_{18}$-alkyl radicals.

Examples of suitable nonionic surface-active compounds, which are preferably used together with anionic surface-active compounds, are, in particular, the reaction products of alkylene oxides (usually ethylene oxide) with alkylphenols ($C_5$–$C_{22}$-alkyl radicals), the reaction products generally containing from 5 to 25 ethylene oxide (EO) units in the molecule; the reaction products of aliphatic ($C_8$ to $C_{18}$) primary or secondary, linear or branched alcohols with ethylene oxide, generally with from 6 to 30 EO, and the adducts of ethylene oxide with reaction products of propylene oxide and ethylenediamine. Other nonionic surface-active compounds are alkyl polyglycosides, long-chain tertiary amine oxides, long-chain tertiary phosphine oxides and dialkyl sulfoxides.

Amphoteric or zwitterionic surface-active compounds can likewise be used in the compositions according to the invention, although in most cases this is not desirable owing to their high cost. If amphoteric or zwitterionic compounds are used, they are generally used in small amounts in compositions predominantly comprising anionic and nonionic surfactants.

Soaps too can be used in the compositions according to the invention, preferably in an amount of less than 25% by weight. They are particularly suitable in small amounts in binary (soap/anionic surfactant) or in ternary mixtures together with nonionic or mixed synthetic anionic and nonionic surfactants. The soaps used are preferably the sodium salts, less preferably the potassium salts, of saturated or unsaturated $C_{10}$–$C_{24}$ fatty acids or mixtures thereof. The amounts of such soaps can be from 0.5% by weight to 25% by weight, with smaller amounts of from 0.5% by weight to 5% by weight generally being sufficient for foam control. Amounts of soaps of between 2% and about 20%, in particular between about 5% and about 10%, have a positive effect. This is especially the case in hard water, where the soap acts as an additional builder substance.

The detergents and cleaners generally also include a builder. Suitable builders are calcium-binding substances, precipitants, calcium-specific ion exchangers and mixtures thereof. Examples of calcium-binding substances include alkali metal polyphosphates, such as sodium tripolyphosphate; nitrilotriacetic acid and its water-soluble salts; the alkali metal salts of carboxymethyloxysuccinic acid, ethylenediaminetetraacetic acid, oxydisuccinic acid, mellitic acid, benzenepolycarboxylic acids, citric acid; and polyacetal carboxylates as disclosed in U.S. Pat. No. 4,144,226 and U.S. Pat. No. 4,146,495.

Examples of precipitants are sodium orthophosphate, sodium carbonate and soaps of long-chain fatty acids.

Examples of ion exchangers that are specific for calcium are the various kinds of water-insoluble, crystalline or amorphous aluminum silicates, of which the zeolites are the best-known representatives.

These builder substances can be present in amounts from 5 to 80% by weight, preferably from 10 to 60% by weight.

In addition to the ingredients already mentioned, the detergents and cleaners may comprise any of the conventional additives in amounts which are commonly encountered in such compositions. Examples of such additives are foam formers, such as alkanolamides, especially the monoethanolamides of palm kernel oil fatty acids and coconut fatty acids; antifoams, such as alkyl phosphates and alkylsilicones; antiredeposition agents and similar auxiliaries, such as sodium carboxymethylcellulose and alkyl- or substituted alkylcellulose ethers; stabilizers, such as ethylenediaminetetraacetic acid; softeners for textiles; inorganic salts, such as sodium sulfate; and, in customarily small amounts, fluorescent substances, perfumes, enzymes such as proteases, cellulases, lipases and amylases, disinfectants, and colorants.

The bleach activators of this invention can be used in a large number of detergents and cleaners. These include textile detergents, textile bleaches, surface cleaners, toilet cleaners, dishwasher detergents, and also denture cleansers. The detergents can be in solid or liquid form. For reasons of stability and ease of handling, it is advantageous to use the bleach activators in the form of granules which, in addition to the bleach activator, comprise a binder. Various methods of preparing such granules are described in the patent literature, for example in CA-1 102 966, GB-1 561 333, U.S. Pat. No. 4,087,369, EP-A-0 240 057, EP-A-0 241 962, EP-A-0 101 634 and EP-A-0 062 523. Any of these methods can be used for the aminonitrile N-oxides to be used according to the invention.

The granules containing the bleach activators are generally added to the detergent composition together with the other dry constituents, such as enzymes or inorganic peroxide bleaches. The detergent composition to which the catalyst granules are added can be obtained by various methods, such as by dry mixing, extrusion and spray drying.

In a further embodiment, the bleach activators according to the invention are particularly suitable for nonaqueous liquid detergents, together with a bleaching peroxide compound, such as sodium perborate, in order to give the detergent a high cleaning power for fabrics and textiles. Nonaqueous liquid detergents of this kind, which include pasty and gelatinous detergent compositions, are known in the prior art and are described, for example, in U.S. Pat. No. 2,864,770, U.S. Pat. No. 2,940,938, U.S. Pat. No. 4,772,412, U.S. Pat. No. 3,368,977, GB-A-1 205 711, GB-A-1 370 377, GB-A-1 270 040, GB-A-1 292 352, GB-A-2 194 536, DE-A-2 233 771 and EP-A-0 028 849.

These compositions are in the form of a nonaqueous liquid medium in which a solid phase may be dispersed. The nonaqueous liquid medium can be a liquid surface-active substance, preferably a nonionic surface-active substance; a nonpolar liquid medium, such as liquid paraffin; a polar solvent, such as polyols, for example glycerol, sorbitol, ethylene glycol, possibly in combination with monohydric alcohols of low molecular mass such as ethanol or isopropanol; or mixtures thereof.

The solid phase may consist of builder substances, alkalis, abrasive substances, polymers, and other solid ionic surface-active substances, bleaches, fluorescent substances, and other customary solid ingredients.

The following, nonlimiting examples are intended to give an overview of the embodiments of the invention.

EXAMPLE 1

Synthesis of para-dimethylaminobenzonitrile N-oxide and the corresponding meta-chlorobenzoic acid salt A solution of 13.8 g of meta-chloroperoxybenzoic acid in 200 ml of methylene chloride was added dropwise to a solution of 11.7 g of para-dimethylaminobenzonitrile in 80 ml of methylene chloride at a temperature of from 0° C. to −5° C. over the course of two hours. When no more peroxide was detectable (negative KI test), the solvent was evaporated on a rotary evaporator. This gave 25.7 g of the meta-chlorobenzoic acid salt of para-dimethylaminobenzonitrile N-oxide. Pure para-dimethylaminobenzonitrile N-oxide was isolated by chromatography on aluminum oxide.

Bleaching tests

The combination of 200 ml of an aqueous solution of reference detergent WMP (Laundry Research Krefeld, 5 g/l in water of German hardness 15°) solution, 150 mg of sodium perborate monohydrate and 50 mg of the particular activator gave a bleach composition. Using this composition, pieces of fabric soiled with the standard soiling BC-1 tea (on cotton, Laundry Research Krefeld) were subjected to a treatment at a temperature of 40° C. in a Linitest apparatus (Heraeus) under isothermal washing conditions. After a wash time of 30 minutes, the pieces of fabric were rinsed with water, dried and ironed, and then the bleaching effect was quantified by determining the differences $\Delta R_{(ACT)}$ in the reflectance before and after bleaching using an ELREPHO 2000 whiteness measuring apparatus (Datacolor). These $\Delta R_{(ACT)}$ values and the $\Delta R_0$ values determined in control experiments without bleach activator were used to calculate the ΔΔR values listed in Table 1, which are a direct measure of the improvement in the bleaching action brought about by the addition of activator:

$$\Delta\Delta R = \Delta R_{(ACT)} - \Delta R_0$$

The compounds 1–5 are

1

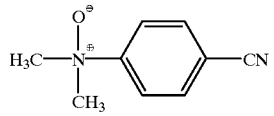

2

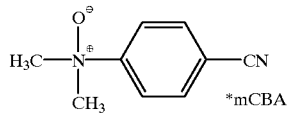

3

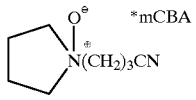

4

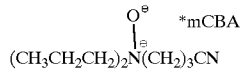

5

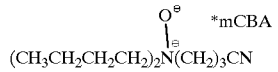

TABLE 1

| | 1 | 2 | 3 | 4 | 5 |
|---|---|---|---|---|---|
| ΔΔR | 1.0 | 0.7 | 1.2 | 0.3 | 0.1 |

mCBA: meta-chlorobenzoic acid salt

The washing experiments show that the aminonitrile N-oxides according to the invention have good bleaching power.

Further advantageous properties of the complexes described are low color damage and low fiber damage.

I claim:

1. A process for bleaching textile or paper comprising the step of contacting said textile or paper with a composition comprising R peroxide compound and an aminonitrile N-oxide or salt thereof of the formula (1)

(1)

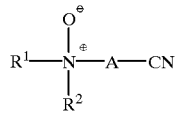

in which $R^1$ and $R^2$ independently of one another are substituted or unsubstituted $C_1$–$C_{15}$-alkyl, which may be substituted by fluorine, chlorine, bromine, $C_1$–$C_5$-alkoxy, $C_1$–$C_5$-alkoxycarbonyl, amino, ammonium, carboxyl, cyano or cyanamino, and A is an arylene radical.

2. The process of claim 1, wherein $R^1$ and $R^2$ are $C_1$–$C_4$-alkyl.

3. A process for cleaning hard surfaces or textiles comprising the step of contacting said hard surfaces or textiles with a composition comprising a peroxide compound and an aminonitrile N-oxide or salt thereof of the formula (1)

(1)

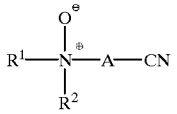

in which $R^1$ and $R^2$ independently of one another are substituted or unsubstituted $C_1$–$C_{15}$-alkyl, which may be substituted by fluorine, chlorine, bromine, $C_1$–$C_5$-alkoxy, $C_1$–$C_5$-alkoxycarbonyl, amino, ammonium, carboxyl, cyano or cyanamino, and A is an arylene radical.

4. The process of claim 1 wherein said aminonitrile of the formula 1 is present in said composition at from 0.05 to 20% by weight.

5. The process of claim 1 wherein said peroxide compound is present in said composition at from 1 to 60% by weight.

6. The process of claim 1 wherein said peroxide compound is selected from the group consisting of perborate, percarbonate, perphosphate, persilicate, monopersulfate, urea peroxide, cumene hydroperoxide and tert-butyl hydroperoxide.

7. The process of claim 1 wherein said composition further comprises a bleach activator other than said aminonitrile N-oxide or salt of formula (1).

8. The process of claim 1 wherein said composition further comprises a surface-active agent.

9. The process of claim 3 wherein said aminonitrile of the formula 1 is present in said composition at from 0.05 to 20% by weight.

10. The process of claim 3 wherein said peroxide compound is present in said composition at from 1 to 60% by weight.

11. The process of claim 3 wherein said peroxide compound is selected from the group consisting of perborate, percarbonate, perphosphate, persilicate, monopersulfate, urea peroxide, cumene hydroperoxide and tert-butyl hydroperoxide.

12. The process of claim 3 wherein said composition further comprises a blench activator other than said aminonitrile N-oxide or salt of formula (1).

13. The process of claim 3 wherein said composition further comprises a surface-active agent.

* * * * *

UNITED STATES PATENT AND TRADEMARK OFFICE

CERTIFICATE OF CORRECTION

PATENT NO. : 6,007,583
DATED : December 28, 1999
INVENTOR(S) : Bernd Nestler

It is certified that error appears in the above-indentified patent and that said Letters Patent is hereby corrected as shown below:

Column 6,
in Claim 1, line 3, "R peroxide" should read - - a peroxide - -

Signed and Sealed this

Twentieth Day of March, 2001

Nicholas P. Godici

*Attest:*

NICHOLAS P. GODICI

*Attesting Officer*

*Acting Director of the United States Patent and Trademark Office*